US006547957B1

(12) United States Patent
Sudhakar et al.

(10) Patent No.: US 6,547,957 B1
(45) Date of Patent: Apr. 15, 2003

(54) PROCESS FOR UPGRADING A HYDROCARBON OIL

(75) Inventors: Chakka Sudhakar, Katy, TX (US); Mark Timothy Caspary, Glenham, NY (US); Stephen Jude DeCanio, Katy, TX (US)

(73) Assignee: Texaco, Inc., White Plains, NY (US)

( * ) Notice: Subject to any disclaimer, the term of this patent is extended or adjusted under 35 U.S.C. 154(b) by 0 days.

(21) Appl. No.: 09/690,380

(22) Filed: Oct. 17, 2000

(51) Int. Cl.[7] ..... C10G 47/12; C10G 45/04

(52) U.S. Cl. ..... 208/111.01; 208/111.3; 208/111.35; 208/213; 208/216 R; 208/217; 208/263

(58) Field of Search ..... 208/111.01, 111.3, 208/111.35, 213, 216 R, 217, 263

(56) References Cited

U.S. PATENT DOCUMENTS

| | | | | |
|---|---|---|---|---|
| 3,622,498 A | * | 11/1971 | Stolfa et al. | 208/108 |
| 3,622,500 A | | 11/1971 | Alpert et al. | |
| 3,725,251 A | | 4/1973 | Alpert et al. | |
| 3,761,393 A | | 9/1973 | Wolk et al. | |
| 3,775,296 A | | 11/1973 | Chervenak et al. | |
| 3,841,996 A | | 10/1974 | Jacobsen | 208/112 |
| 3,844,933 A | | 10/1974 | Wolk et al. | |
| 3,933,620 A | * | 1/1976 | Russum et al. | 208/108 |
| 4,952,306 A | * | 8/1990 | Sawyer et al. | 208/216 R |
| 5,928,501 A | | 7/1999 | Sudhakar et al. | |
| 5,935,418 A | | 8/1999 | Chakrabarty et al. | 208/108 |

OTHER PUBLICATIONS

Oil & Gas Journal, "Number of catalyst formulations stable in a tough market", Oct. 6, 1997, pp. 41–72.
Oil & Gas Journal, "Catalyst Numbers Steady; M&A Activity Hot", Sep. 27, 1999, pp. 45–68.

* cited by examiner

*Primary Examiner*—Walter D. Griffin
(74) *Attorney, Agent, or Firm*—Dilworth & Barrese, LLP

(57) ABSTRACT

A catalyst assisted upgrading process for treating a hydrocarbon oil feed to reduce total acid number (TAN) and increase API gravity is provided herein which employs a hydroprocessing catalyst based on a catalyst support, e.g., alumina. The process includes blending the supported hydroprocessing catalyst with the hydrocarbon oil feed to form a slurry which is then treated with hydrogen at moderate temperature and pressure in, for example, a tubular reactor. Deposit formation is thus minimized or avoided.

24 Claims, 1 Drawing Sheet

PROCESS FOR UPGRADING A HYDROCARBON OIL

BACKGROUND OF THE INVENTION

This disclosure generally relates to a process for treating a hydrocarbon oil. More particularly, the process described herein is directed to upgrading a heavy oil feedstock by a supported hydroprocessing catalyst assisted hydrotreatment.

In general, crude oils range widely in their composition and physical and chemical properties. Heavy crude oils are typically characterized by a relatively high viscosity, low API gravity (generally lower than 25°), high concentrations of sulfur, nitrogen and metallic impurities and a high percentage of high boiling components. In the last two decades, environmental and economical considerations have required the development of processes to (1) remove heteroatoms such as, for example, sulfur, nitrogen, oxygen and metallic impurities, from the hydrocarbon oil feedstocks; and, (2) convert the hydrocarbon oil feedstocks to lower their boiling ranges. Such processes generally subject the heavy crudes or their fractions to thermal cracking or hydrocracking to convert the higher boiling fractions to lower boiling fractions optionally followed by hydrotreating to remove the heteroatoms.

Acidic compounds such as naphthenic acids are often present in crude oils and pose a serious problem in processing such crudes. Naphthenic acids are carboxylic acids having a ring structure, usually of five member carbon rings, with side chains of varying length. Such acids are corrosive towards metals and must be removed by, for example, treatment with aqueous solutions of alkalis such as sodium hydroxide to form alkali naphthenates. However, with increasing molecular weight, the alkali naphthenates become more difficult to separate because they become more soluble in the oil phase and are powerful emulsifiers.

The acid content of a hydrocarbon oil is measured by the total acid number or "TAN" which is defined as milligrams of potassium hydroxide (KOH) necessary to neutralize the acid in 1 gram of oil. Typical refineries can process crudes having a TAN of up to 0.3. Some crude oils have TAN's of more than 4.0, e.g., Mariner crude from the North Sea, making it difficult to process such heavy crude oils.

Processes for treating hydrocarbon oils are known. See, e.g., U.S. Pat. Nos. 3,622,500; 3,725,251; 3,761,393; 3,775,296; and 3,844,933. Each of these patents disclose processes which operate at high pressures and employ high concentrations of catalysts in the form of small particles.

Another example of a process for treating hydrocarbon oils is U.S. Pat. No. 5,928,501 which discloses a process employing a catalyst composition having high hydrogenation activity and being formed from a non-noble metal of Group VIII of the periodic table and a metal of Group VIB of the periodic table on a phosphorus-treated carbon support. However, several problems are associated with employing a carbon supported catalyst. For example, presently there exists no proven technology for regenerating a carbon supported catalyst after it has been substantially deactivated during the hydrotreating process. Thus, in order to continue the process, new carbon supported catalyst must be purchased since it is not possible to regenerate and therefore reuse the carbon supported catalyst after it has been recycled several times.

It would therefore be desirable to provide a process to upgrade heavy acidic hydrocarbon oils to simultaneously reduce acidity and increase API gravity thereby improving the marketability of the crude oil and increasing its value. It would also be desirable to operate the upgrading process at moderate pressures which would be more economical to set up and easier to operate. Furthermore, it would be desirable to employ a catalyst which can be regenerated resulting in a substantially longer cycle life and lower overall costs.

SUMMARY OF THE INVENTION

In accordance with the present invention a process for treating a hydrocarbon oil feed is provided which comprises:

a) forming a slurry which includes a heavy hydrocarbon oil and a catalytically effective amount of a hydroprocessing catalyst based on a catalyst support selected from the group consisting of alumina, silica-alumina, silica, titania, and magnesia;

b) introducing the slurry into a reaction zone in the presence of hydrogen; and, c) subjecting the slurry to upgrading conditions to provide a hydrocarbon oil product having a lower acid number and increased API gravity wherein the concentration of the catalyst in the slurry is substantially the same as the concentration of the catalyst in the slurry present in the reactor and in the hydrocarbon oil product.

The term "regenerable" as utilized herein shall be understood as referring to those supported hydroprocessing catalysts which can be subjected to a known regeneration process thereby allowing the catalysts to be regenerated and then reused in the upgrading process. For example, in a typical regeneration process, the supported hydroprocessing catalysts are calcined at high temperatures, e.g., temperatures above about 450° C., in air to burn off any impurities in the catalysts, e.g., coke deposits.

The foregoing process advantageously reduces (1) the acid number of the hydrocarbon oil feeds; (2) the viscosity of the hydrocarbon oil feeds; and, (3) the sulfur content present in the hydrocarbon oil feeds while also substantially increasing the API gravity. The content of asphaltenes, nitrogen and metallic impurities present in the hydrocarbon oil are also reduced. The product oil therefore contains significantly reduced concentration of residue (material boiling above about 524° C.) compared to feed hydrocarbon oil.

BRIEF DESCRIPTION OF THE DRAWING

Various embodiments are described herein with reference to the drawing wherein.

DESCRIPTION OF THE PREFERRED EMBODIMENTS

Figure 1:
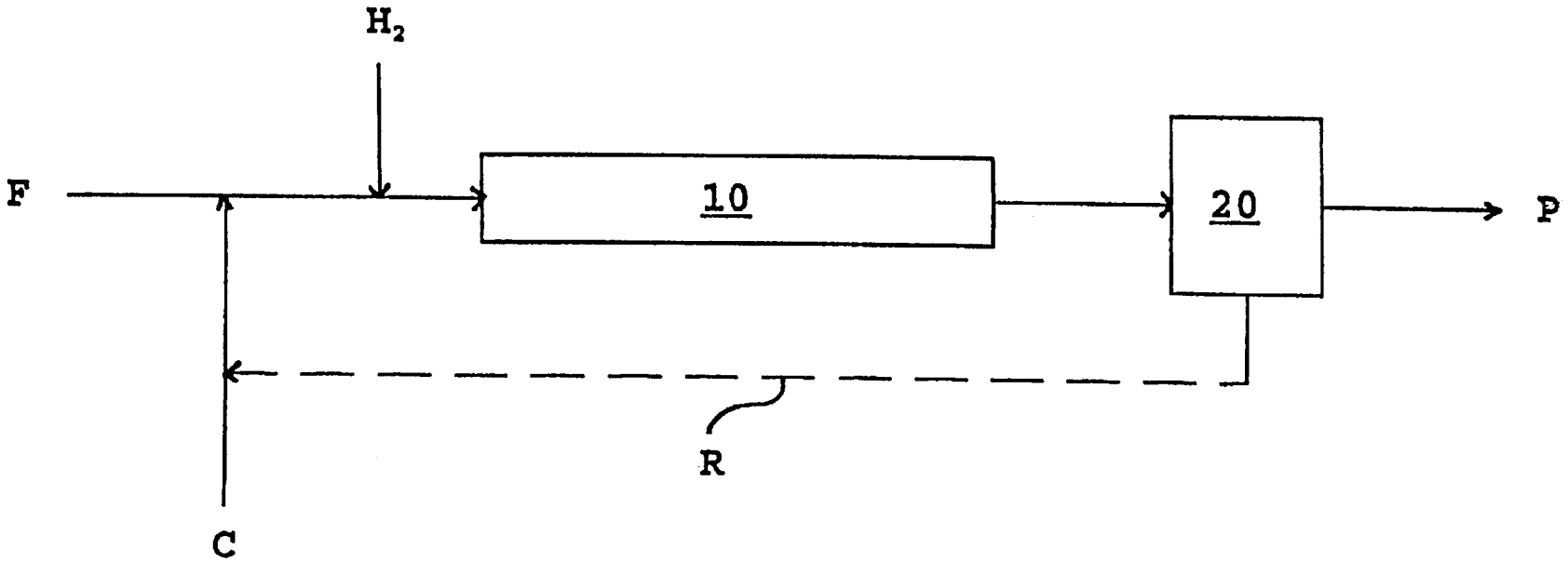
FIG. 1 is a diagrammatic view showing the process of the present invention.

The process described herein for upgrading hydrocarbon oils, and particularly heavy oils, is especially useful to reduce the TAN of highly acidic heavy crudes while increasing the API gravity and reducing the sulfur content of the oil. The TAN of the hydrocarbon oil product produced from the process disclosed herein is less than about 0.8, preferably less than about 0.5, and more preferably less than about 0.3. The API gravity can generally be increased by about 4–12° in the process of the present invention. The oil laden with the catalyst particles is subjected to moderate temperatures and pressures in the presence of hydrogen for a certain period of time, after which the hydroprocessing catalyst may be recovered and recycled back into the process. The hydroprocessing catalyst may also be regenerated after several cycles such that the catalyst can then be reused in the process herein. Additionally, the process disclosed herein is advantageously utilized such that the concentration of the catalyst combined with the heavy hydrocarbon oil to form the slurry is substantially the same as the concentration of the catalyst in the slurry present in the reactor during the process which is substantially the same as the concentration of the catalyst in the hydrocarbon oil product prior to the catalyst being separated from the oil product.

Various types of reactors known to one skilled in the art can be used to accomplish the upgrading of the hydrocarbon oil. For example, one suitable type of reactor is a fluidized bed reactor wherein a slurry of the hydrocarbon feed containing the hydroprocessing catalyst is reacted in a fluidized bed reactor in the presence of hydrogen. Another suitable reactor system is an ebullated bed reactor wherein spent hydroprocessing catalyst is continuously removed and fresh or regenerated hydroprocessing catalyst is continuously added. A preferred reactor for use herein is a simple hydrovisbreaker-like entrained-bed process in which the hydroprocessing catalyst is premixed with the hydrocarbon oil to form a slurry, and the slurry along with added hydrogen is then fed through a heated tubular reactor. This process is represented in FIG. 1, which is now referred to.

Feedstock F of the present invention can be any whole crude oil, dewatered and/or desalted crude oil, topped crude oil, deasphalted oil, crude oil fractions such as vacuum gas oil and residua, water emulsions of crude oil or heavy fractions of the crude oil, oil from coal liquefaction, shale oil, or tar sand oil. Many such feedstocks have low API gravities of the order of 25° or less, and many possess TAN numbers greater than 0.3.

It should be understood that the process of the present invention can also be used as an API gravity upgrading process for heavy hydrocarbon oils that do not possess any significant acidity.

The hydroprocessing catalyst C used herein can be any commercially available hydroprocessing catalyst known to one skilled in the art, e.g., Criterion Catalyst Company (Houston, Tex.), Akzo Nobel (Houston, Tex.), etc. Suitable hydroprocessing catalysts include those disclosed in Oil & Gas Journal, Sep. 27, 1999, pages 45–68, under the headings of "Hydrocracking catalysts", "Mild hydrocracking catalysts", "hydrotreating/hydrogenation/saturation catalysts", and "hydrorefining catalysts" and in Oil & Gas Journal, Oct. 6, 1997, pages 51–62, the contents of which are incorporated by reference herein. The hydroprocessing catalysts for use herein are preferably based on an alumina catalyst support, though other supports such as, for example, silica-alumina, silica, titania, magnesia, and the like, are also suitable for the present application. The catalytic metals on the surface of, for example, alumina, may consist of, for example, cobalt, nickel, molybdenum, tungsten, combinations thereof and the like with the combination of cobalt and molybdenum being preferred.

It is also advantageous to include catalytic promoters in the catalyst employed herein. Catalytic promoters present in the catalyst include, but are not limited to, phosphorus, halogens, silica, zeolites, alkali and alkaline earth metal oxides, combinations thereof and the like that are known to those knowledgeable in the art.

The particle size or shape of the hydroprocessing catalyst required for the process of the present invention is generally dictated by the reactor system utilized for practicing the invention. For example, in a visbreaker-like process employing a tubular reactor, finely ground catalyst is preferred. In an ebullated bed process, the catalyst in the form of extrudates, pellets, or spheres may be advantageously utilized.

Referring again to FIG. 1, reactor 10 is preferably a simple tubular reactor with or without internal structures. Hydrogen is added to the hydrocarbon/hydroprocessing catalyst slurry prior to entry of the feed into the reaction zone. Hydrogen is preferably added to the hydrocarbon/hydroprocessing catalyst slurry prior to entry of the feed into the preheater before the reactor. The process conditions of the process disclosed herein include a temperature of from about 350° C. to about 500° C. and preferably from about 400° C. to about 450° C.; a pressure of from about 150 psig to about 1,000 psig and preferably from about 200 psig to about 800 psig; a hydroprocessing catalyst concentration in the slurry of from about 0.01% to about 10% by weight and preferably from about 0.02% to about 2% by weight of the feed; a feed liquid hourly space velocity (LHSV) of from about 0.1 to about 5; and a gas flow of from about 100 to about 10,000 SCFB (Standard cubic feet per barrel) of hydrogen of at least about 70% purity. Alternatively, other gases such as nitrogen, natural gas and fuel gas may also be used along with hydrogen.

As can be readily appreciated by one skilled in the art, formation of deposits on the interior surface of the metallic reactor is a severe disadvantage. Deposits obstruct the flow of reactants through the reactor, and severely limit the time period in which the process can be continuously on-stream without stoppage for maintenance. Surprisingly, the process of the present invention minimizes the formation of deposits.

The effluent from the reactor 10 can optionally be sent to a soaker to undergo heat soaking where the oil might undergo further upgrading. The effluent may also be sent to one or more fractionators or flashing units to separate distillable oil components from the overall product. After the effluent slurry has been degassed, the catalyst is separated from the effluent slurry, for example, with the help of a filtration apparatus or a centrifuge 20. Any known technique can be used to separate the catalyst from the oil, including gravity separation. In some cases the catalyst separation from the upgraded oil may not be necessary. The resulting treated hydrocarbon oil product P can be sent to further processing or for sale. The hydroprocessing catalyst can optionally be sent back to the hydrocarbon feed stream F via recycle stream R. The hydroprocessing catalyst can also optionally be regenerated by techniques known in the art and then sent back to the hydrocarbon feed stream F.

The following examples are illustrative of the hydroprocessing catalyst assisted upgrading process of the present invention and are not intended as limitations of the invention. Comparative Example A is provided to show the importance of using the hydroprocessing catalyst for the upgrading process disclosed herein.

Experimental Procedure

The whole crude oil employed in each of the following examples was provided having the properties and composition set forth in Table 1 below. Composition percentages are by weight unless otherwise indicated:

TABLE 1

| Properties of whole crude oil | |
|---|---|
| API GRAVITY | 15° |
| Boiling Range (weight %, normalized) | |
| IBP | 151° C. |
| 10% boiling below | 261° C. |

TABLE 1-continued

| Properties of whole crude oil | |
|---|---|
| 50% boiling below | 425° C. |
| 90% boiling below | 616° C. |
| 99.9% boiling below | 710° C. |
| Wt. % boiling above 524° C. | 26% |
| Sulfur content | 1.0% |
| Carbon content | 84.4% |
| Hydrogen content | 11.1% |
| Nitrogen content | 0.41% |
| Vanadium content | 14 ppm |
| Nickel content | 4 ppm |
| Iron content | 22 ppm |
| Asphaltene content | ~2% heptane insolubles |
| Water content | 1.5% |
| Total Acid Number (TAN) | 4.2 |

A tubular stainless steel reactor having 19 mm inner diameter and 40 cm length was provided for each of the experiments. The reactor tube had no internal structures. The internal volume of the reactor in the heated zone was approximately 120 cc. Prior to running each of the experiments the weight of the reactor tube was determined.

Commercially available alumina supported Co—Mo or Ni—Mo catalysts from Criterion Catalyst Company (Houston, Tex.) were used as hydroprocessing catalysts to demonstrate the process of the present invention. The hydroprocessing catalysts were finely ground and the fraction between a 200 or 400 mesh screen was used in the experiments. A desired quantity of the finely ground catalyst was thoroughly blended with the crude oil in a high speed blender. The blended oil containing the catalyst was then used as the feed for the experimental runs to demonstrate the invention. In some experiments, a sulfiding agent such as tertiary nonyl polysulfide (TPS-37) containing approximately 37 weight percent sulfur was added to the catalyst containing oil feed. The sulfiding agent helps to convert metals such as Co, Ni and Mo in the catalyst, in situ, into the active sulfide form. However, the experimental results were essentially similar in several experiments when no sulfiding agent was added to the oil feed.

After attaching the reactor to the catalyst screening unit, the reaction temperature was programmed to increase gradually to a predetermined reaction temperature in about 120 minutes or 60 minutes in some cases and remain constant thereafter. In a typical experiment, the liquid feed pump was started at 100 or 130 cc/hour as soon as the temperature program began. The flow of hydrogen gas was also started at the same time at the desired rate. The pressure inside the reactor was allowed to build while the heating took place. The time when the temperature and pressure inside the reactor reached the predetermined reaction temperature and pressure was taken as the starting time of the reaction.

Liquid product samples were collected at various reaction times on stream typically at one hour intervals and degassed with the help of an ultrasonic bath before they were analyzed for their sulfur, carbon, hydrogen and nitrogen contents. The sulfur content of the feed and product samples were determined by X-ray fluorescence ("XRF", D2622). They were also analyzed by high temperature GC simulated distillation ("SIMDIS") to determine their boiling ranges. The TAN values of the feed and product samples were determined by the D664 method. The concentrations of the metallic impurities such as vanadium, nickel, and iron and non-metallic impurities such as sodium, chlorine, magnesium and calcium were determined by the XRF spectroscopy. Water concentrations were determined using Carl Fisher titration. Oil densities were measured with a Mettler densitomer at 15° C. The fraction boiling above 975° F. was considered as pitch.

At the end of the run, after the reactor is cooled down to about 250° C., light petroleum naphtha, and toluene in some cases, was pumped through the reactor at about 400 cc/hour for one hour while the reactor continued to cool down to room temperature to remove all remaining crude oil. After draining the reactor, the remaining naphtha and/or toluene was removed from the reactor by applying vacuum. The reactor was then weighed again, the difference between the final weight and the initial weight indicating the increase in weight attributable to deposits formed on the interior walls of the reactor.

EXAMPLE 1

3000 Grams of the whole crude oil having the composition given in Table 1 was blended with 7.5 g of a finely ground commercially available alumina supported Co—Mo hydroprocessing catalyst to form a reactor feed slurry with the slurry being used as the feed. We shall refer to the catalyst as ACIDCAT-1. 30 Grams of TPS-37 sulfiding agent was added to the oil before blending with the catalyst. The slurry was fed into the reactor at 130 g/hr with a hydrogen flow of 500 cc/min. The reactor temperature was programmed to increase gradually to a predetermined reaction temperature of 430° C. for one experiment and to 439° C. for a second experiment in about 120 minutes. The temperature in both experiments is programmed to remain constant thereafter. The time when the temperature reached the predetermined reaction temperature for each experiment was taken as the starting time of the reaction. The total pressure was then adjusted for each experiment to the desired pressure of 400 psig. The experimental results of this example are set forth below in Table 2.

EXAMPLE 2

3000 Grams of the whole crude oil having the composition given in Table 1 was blended with 7.5 g of a finely ground ACIDCAT-1 hydroprocessing catalyst to form a reaction feed slurry with the slurry being used as the feed. 30 Grams of TPS-37 sulfiding agent was added to the oil before blending with the catalyst. The slurry was fed into the reactor at 130 g/hr with a hydrogen flow of 500 cc/min. The reactor temperature was programmed to increase gradually to a predetermined reactor temperature of 429° C. for one experiment and to 440° C. for a second experiment in about 120 minutes. The temperature in both experiments remained constant thereafter. The time when the temperature reached the predetermined reaction temperature for each experiment was taken as the starting time of the reaction. The total pressure was then adjusted for each experiment to the desired pressure of 600 psig. The experimental results of this example are set forth below in Table 2.

EXAMPLE 3

3000 Grams of the whole crude oil having the composition given in Table 1 was dewatered and desalted and then blended with 3 g of a finely ground ACIDCAT-1 hydroprocessing catalyst to form a reactor feed slurry with the slurry being used as the feed. 30 Grams of TPS-37 sulfiding agent was added to the oil before blending with the catalyst. The slurry was fed into the reactor at 130 g/hr with a hydrogen flow of 500 cc/min. The reactor temperature was programmed to increase gradually to a predetermined reaction temperature of 435° C. in about 60 minutes and remain constant thereafter. The time when the temperature reached the predetermined reaction temperature was taken as the starting time of the reaction. The total pressure was then adjusted to the desired pressure of 600 psig. The experimental results of this example are set forth below in Table 2.

EXAMPLE 4

3000 Grams of the whole crude oil having the composition given in Table 1 was blended with 7.5 g of a finely ground ACIDCAT-1 hydroprocessing catalyst to form a reactor feed slurry with the slurry being used as the feed. 30 Grams of TPS-37 sulfiding agent was added to the oil before blending with the catalyst. The slurry was fed into the reactor at 105 g/hr with a hydrogen flow of 800 cc/min. The reactor temperature was programmed to increase gradually to a predetermined reaction temperature of 426° C. for one experiment and to 435° C. for a second experiment in about 60 minutes. The temperature in both experiments remained constant thereafter. The time when the temperature reached the predetermined reaction temperature for each experiment was taken as the starting time of the reaction. The total pressure was then adjusted for each experiment to the desired pressure of 400 psig. The experimental results of this example are set forth below in Table 2.

EXAMPLE 5

3000 Grams of the whole crude oil having the composition given in Table 1 was blended with 7.5 g of a finely ground commercially available alumina supported Ni—Mo hydroprocessing catalyst to form a reactor feed slurry with the slurry being used as the feed. 30 Grams of TPS-37 sulfiding agent was added to the oil before blending with the catalyst. The slurry was fed into the reactor at 105 g/hr with a hydrogen flow of 800 cc/min. The reactor temperature was programmed to increase gradually to a predetermined reaction temperature of 424° C. for one experiment and to 432° C. for a second experiment in about 60 minutes with all other conditions remaining constant. The temperature in both experiments remained constant thereafter. The time when the temperature reached the predetermined reaction temperature for each experiment was taken as the starting time of the reaction. The total pressure was then adjusted for each experiment to the desired pressure of 400 psig. The experimental results of this example are set forth below in Table 2.

Comparative Example A

The experiment of this Comparative Example was conducted with the same material and equipment as described above and performed in the same manner except the crude oil feed was reacted without catalyst or sulfiding agent. The reaction was conducted at temperatures of 424° C. for one experiment and to 434° C. for a second experiment at a pressure of 400 psig. The hydrogen flow was 800 cc/min. and the feed rate was 105–110 g/hr. The experimental results of this Comparative Example are set forth below in Table 2.

TABLE 2

Experimental Results

| Sample | Feed Rate (g/hr) | Reaction Temp. (° C.) | API° Gravity Increase | Hydrogen Flow Rate (cc/min) | Sulfur Reduction | TAN Reduction | Pitch Conversion | 50 wt. % boiling point (° C.) | Reactor weight gain |
|---|---|---|---|---|---|---|---|---|---|
| Example 1 | 130 | 430 | 5.0 | 500 | 7 | 85 | N.D. | N.D. | 15 g |
| (400 psig) | 130 | 439 | 7.5 | 500 | 14 | 92 | | | |
| Example 1 | 130 | 429 | 5.0 | 500 | Negligible | 83 | N.D. | N.D. | 3.5 g |
| (600 psig) | 130 | 440 | 7.5 | 500 | Negligible | 92 | | | |
| Example 3 | 130 | 435 | 6.5 | 500 | Negligible | 89 | 35 | 351 | 7 g |
| (600 psig) | | | | | | | | | |
| Example 4 | 105 | 426 | 6.0 | 800 | 11 | 93 | N.D. | N.D. | 8 g |
| (400 psig) | 105 | 435 | 7.5 | 800 | 18 | 97 | | | |
| Example 5 | 105 | 424 | 6.5 | 800 | 7 | 78 | N.D. | N.D. | ~20 g |
| (400 psig) | 105 | 432 | 8.5 | 800 | 18 | 83 | | | |
| Comp. Ex. A | 105 | 423 | 5.0 | 800 | 0 | | 31 | 323 | |
| (400 psig) | 110 | 435 | 7.0 | 800 | 5 | 88 | 46 | 358 | 160 g |

As can be seen from the above results shown in Table 2, the process of the present invention substantially reduces the TAN of the whole crude oil while substantially improving its API gravity, reducing its pitch or residue content, and reducing its sulfur content. Substantial reduction of TAN can also be achieved by the thermal hydrotreating reaction alone i.e., Comparative Example A (wherein no catalyst was used). However, the thermal hydrotreating process without catalyst cannot be run for significant lengths of time because of the formation of large amount of deposits in the interior of the reaction tubes. In contrast to the thermal non-catalytic process, the catalyst assisted process of the present invention greatly reduces the formation of deposits and thereby allows the treating process to be performed simply, efficiently and continuously in a simple reactor system. Thus, it has surprisingly been discovered that a commercially available alumina supported hydroprocessing catalyst provided satisfactory results for a hydrocarbon upgrading process.

EXAMPLE 6

This example is illustrative of the process of the present invention for upgrading an acidic super heavy whole crude oil which has an API gravity of only 8.5% and possesses extremely high viscosity at ambient conditions. The experiment was conducted with 0.25 weight percent of ACIDCAT-1 hydroprocessing catalyst mixed in with the feed whole crude oil at a total pressure of 600 psig and a nominal liquid hourly space velocity of 1. The reactor was remarkably clean at the end of the run. The experimental results of this example are set forth below in Table 3.

TABLE 3

| Property | Whole crude | Processed Product |
|---|---|---|
| API Gravity | 8.5 | 16–17 |
| Sulfur (wt %) | 4.1 | 3–3.2 |
| Viscosity, cP at 50° C. | 32,000 | 80 |
| TAN (mg KOH/g oil) | 2.8 | 0.3–0.4 |
| Composition by GC Simulated Distillation | | |
| Naphtha (IBP-350° F.) wt % content | 0.5 | 10.6 |
| Distillate (350–650° F.) wt % content | 12.5 | 29.2 |
| Gas Oil (650–1000° F.) wt % content | 32.6 | 30.4 |
| Residue (1000+° F.) wt % content | 54.4 | 29.8 |

As can be seen from the above results shown in Table 3 the process of the present invention can significantly improve the quality, marketability, and value of extra-heavy crude oils. These data show that (1) the API gravity of the oil is improved by about 8°; (2) its sulfur content is lowered by about 25%; (3) its viscosity was reduced by almost a factor of 400; and (4) its acid number is lowered to negligible levels in this process. There was also about a 40% reduction in the asphaltene content and a 45% reduction in the residue content. In order to obtain the maximum benefits from this process, the process is preferably conducted at or near the oil production site. The upgraded higher value crude oil would be much easier to transport for sale or for further processing.

It will be understood that various modifications may be made to the embodiments disclosed herein. Therefore the above description should not be viewed as limiting but merely as exemplifications of preferred embodiments. Those skilled in the art will envision other modifications within the scope and spirit of the claims appended hereto.

What is claimed is:

1. A process for treating a heavy hydrocarbon oil feed comprising:

a) forming a slurry which includes a heavy hydrocarbon oil and a hydroprocessing catalyst based on a catalyst support selected from the group consisting of alumina, silica-alumina, silica, titania, and magnesia;

b) introducing said slurry into a reaction zone in the presence of hydrogen; and, c) subjecting the slurry to upgrading conditions to provide a hydrocarbon oil product having an improved API gravity and a lower acid number wherein the concentration of the catalyst in the slurry is substantially the same as the concentration of the catalyst in the slurry present in the reactor and in the hydrocarbon oil product and wherein the concentration of the hydroprocessing catalyst present in the slurry is between about 0.02 to about 2.0 percent by weight.

2. The process of claim 1 wherein the hydroprocessing catalyst is regenerable and is selected from the group consisting of hydrocracking catalysts, mild hydrocracking catalysts, hydrotreating/hydrogenation/saturation catalysts, and hydrorefining catalysts.

3. The process of claim 2 wherein the regenerable hydroprocessing catalyst is selected from the group consisting of an alumina supported Co—Mo catalyst and alumina supported Ni—Mo catalyst.

4. The process of claim 1 wherein the heavy hydrocarbon oil feed comprises an oil selected from the group consisting of whole crude oil, dewatered crude oil, desalted crude oil, topped crude oil, deasphalted oil, vacuum gas oils, petroleum residua, water emulsion of crude oil, water emulsions of heavy fractions of crude oils, oil from coal liquefaction, shale oil and tar sand oil.

5. The process of claim 1 wherein the hydrocarbon oil feed comprises whole crude oil.

6. The process of claim 1 wherein the hydrocarbon oil feed has a total acid number of at least 0.3 and an API gravity of no more than 25°.

7. The process of claim 1 wherein the hydrocarbon oil feed has no measurable total acid number and an API gravity of no more than 25°.

8. The process of claim 1 wherein the slurry is a substantially uniform suspension of the catalyst in the hydrocarbon oil feed.

9. The process of claim 1 further comprising the step of separating out the catalyst from the hydrocarbon oil product and recycling the separated catalyst, with or without regeneration, to the hydrocarbon oil feed.

10. The process of claim 9 wherein the catalyst is presulfided prior to forming the slurry in step (a).

11. The process of claim 1 wherein the acid number of the hydrocarbon oil product is less than about 25% that of the hydrocarbon oil feed.

12. The process of claim 1 wherein the API gravity of the hydrocarbon oil product is at least about 4° higher than that of the hydrocarbon oil feed.

13. The process of claim 12 wherein the reaction temperature is from about 400° C. to about 450° C. and the reaction pressure is from about 200 psig to about 800 psig.

14. The process of claim 1 wherein the upgrading conditions include a reaction temperature of from about 350° C. to about 500° C., a pressure of from about 150 psig to about 1,000 psig, a liquid hourly space velocity of from about 0.1 to about 5.0 and a hydrogen feed rate of from about 100 to about 10,000 SCFB.

15. The process of claim 1 wherein the catalyst is used without presulfiding.

16. The process of claim 1 wherein the catalyst is presulfided.

17. The process of claim 1 wherein the catalyst is sulfided in situ by adding a decomposable sulfur compound to the hydrocarbon oil feed before passing the slurry into the reaction zone.

18. The process of claim 1 wherein a portion of hydrogen sulfide generated in the process is recycled back into the process.

19. The process of claim 1 further comprising the step of heat soaking the hydrocarbon oil product.

20. The process of claim 1 wherein the hydrogen used is of at least 70% purity.

21. The process of claim 1 wherein the catalyst further comprises at least one catalytic promoter.

22. The process of claim 21 wherein the catalytic promoter is selected from the group consisting of phosphorus, halogens, silica, zeolites, alkali and alkaline earth metal oxides, and combinations thereof.

23. The process of claim 1 further comprising the steps of:

d) separating the product hydrocarbon oil into light and heavy fractions; and, e) recycling the heavy fractions.

24. The process of claim 1 wherein the hydroprocessing catalyst, under the upgrading process conditions, does not provide substantial cracking activity, desulfurization activity, or total acid number reduction activity.

* * * * *